US006209961B1

(12) United States Patent
Chen

(10) Patent No.: US 6,209,961 B1
(45) Date of Patent: Apr. 3, 2001

(54) LEVEL-ADJUSTABLE AND SWIVELABLE ARMREST ASSEMBLY

(76) Inventor: Su-Jan Chen, P.O. Box 63-247, Taichung (TW)

( * ) Notice: Subject to any disclaimer, the term of this patent is extended or adjusted under 35 U.S.C. 154(b) by 0 days.

(21) Appl. No.: 09/542,831

(22) Filed: Apr. 4, 2000

(51) Int. Cl.[7] ..... A47C 7/54
(52) U.S. Cl. ..... 297/411.36; 297/411.35
(58) Field of Search ..... 297/411.2, 411.35, 297/411.36, 353; 248/418, 425

(56) References Cited

U.S. PATENT DOCUMENTS 5,393,124 * 2/1995 Neil ..... 297/411.35
5,597,204 * 1/1997 Karaus, Jr. ..... 297/353
5,848,823 * 12/1998 Su ..... 297/411.35
5,853,223 * 12/1998 Ritt et al. ..... 297/411.35 X
6,050,634 * 4/2000 Yamagishi et al. ..... 297/411.36 X

* cited by examiner

*Primary Examiner*—Peter R. Brown
(74) *Attorney, Agent, or Firm*—Rosenberg, Klein & Lee

(57) ABSTRACT

An armrest assembly includes a tube secured to a chair seat and an adjusting seat mounted in the tube. The adjusting seat includes an adjusting section having a first vertical slide passage. A peripheral side defining the first vertical slide passage includes a number of vertically spaced positioning notches. The adjusting section further includes a second vertical slide passage, the first vertical side passage and the second vertical slide passage together defining a loop passage. An armrest is mounted above the adjusting seat. An actuating member includes an upper end secured to the armrest to move therewith. The actuating member further includes a lower end slidably received in the adjusting seat. A positioning member is attached to the actuating member and includes an end slidable along the loop passage so as to be selectively and releasably engaged in one of the positioning notches for supporting the armrest at a desired level.

17 Claims, 11 Drawing Sheets

A-A

B-B

A-A

B-B

A-A

LEVEL-ADJUSTABLE AND SWIVELABLE ARMREST ASSEMBLY

BACKGROUND OF THE INVENTION

1. Field of the Invention

The present invention relates to an armrest assembly that is adjustable in level and swivelable to provide the user with comfortable sitting.

2. Description of the Related Art

FIGS. 10 and 11 illustrate a conventional level-adjusting device for an armrest of a chair. The level-adjusting device includes a fixing seat 1' and an adjusting seat 2'. A retainer 3' is secured between the fixing seat 1' and the adjusting seat 2' by a screw 7' for retaining the fixing seat 1' in place. A side of the retainer 3' is born against by a spring 6' and an upper side of the retainer 3' is biased by an elastic plate 4'. A positioning plate 5' is mounted on top of the retainer 3' and the elastic plate 4'. The retainer 3' may slide along a vertical slide passage 13' in the fixing seat 1' and be selectively engaged with one of a number of positioning notches 12' in the fixing seat 1'. The retainer 3' is retained in a selected positioning notch 12' upon changing angular position of the elastic plate 4' for positioning the retainer 3' and the screw 7'. Although the device may provide the required height-adjusting function, the assembly procedure for the retainer 3' and the spring 6' as well as other elements is relatively difficult and thus has a high cost. The overall structure is weak and the adjusting movement is not reliable, as there are too many elements.

SUMMARY OF THE INVENTION

It is a primary object of the present invention to provide an armrest assembly that is adjustable in level and swivelable to provide the user with comfortable sitting.

In accordance with a first aspect of the invention, an armrest assembly comprises:

a tube adapted to be secured to a chair seat;

an adjusting seat mounted in the tube and including an adjusting section, the adjusting section including a first vertical slide passage, a peripheral side defining the first vertical slide passage including a plurality of vertically spaced positioning notches, the adjusting section further including a second vertical slide passage, the first vertical side passage and the second vertical slide passage together defining a loop passage;

an armrest mounted above the adjusting seat; and an actuating member including an upper end secured to the armrest to move therewith, the actuating member further including a lower end slidably received in the adjusting seat, the actuating member including a positioning member attached thereto, the positioning member including an end slidable along the loop passage and being selectively and releasably engaged in one of the positioning notches for supporting the armrest at a desired level.

Each positioning notch includes an opening that faces upward and outward. The lower end of the actuating member includes a hole and the positioning member includes a second end engaged in the hole of the actuating member. The adjusting seat includes a longitudinal slot along a length thereof for slidably receiving the lower end of the actuating member. A sleeve is slidably mounted around the tube and securely engaged with the armrest to slide therewith. The chair seat includes an extension, and further comprises a mounting seat including a slot through which the extension extends. The adjusting seat includes a lower end securely attached to the extension located in the mounting seat. The tube includes a plurality of angularly spaced positioning holes. A positioning element is mounted to the adjusting seat and means is provided for biasing the positioning element to releasably engage with one of the positioning holes, thereby allowing the armrest to be swiveled relative to the chair seat. In an embodiment of the invention, the positioning element is a ball, and the biasing means is an elastic element.

In accordance with a second aspect of the invention, an armrest assembly comprises:

a tube adapted to be secured to a chair seat, the tube including a plurality of angularly spaced positioning holes;

an adjusting seat mounted in the tube;

an armrest mounted above the adjusting seat; and an actuating member including an upper end secured to the armrest to move therewith, the actuating member further including a lower end engaged in the adjusting seat, whereby swivel movement of the armrest cause swivel movement of the adjusting seat, a positioning element mounted to the adjusting seat, and means for biasing the positioning element to releasably engaged with one of the positioning holes, thereby allowing the armrest to be swiveled relative to the chair seat.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
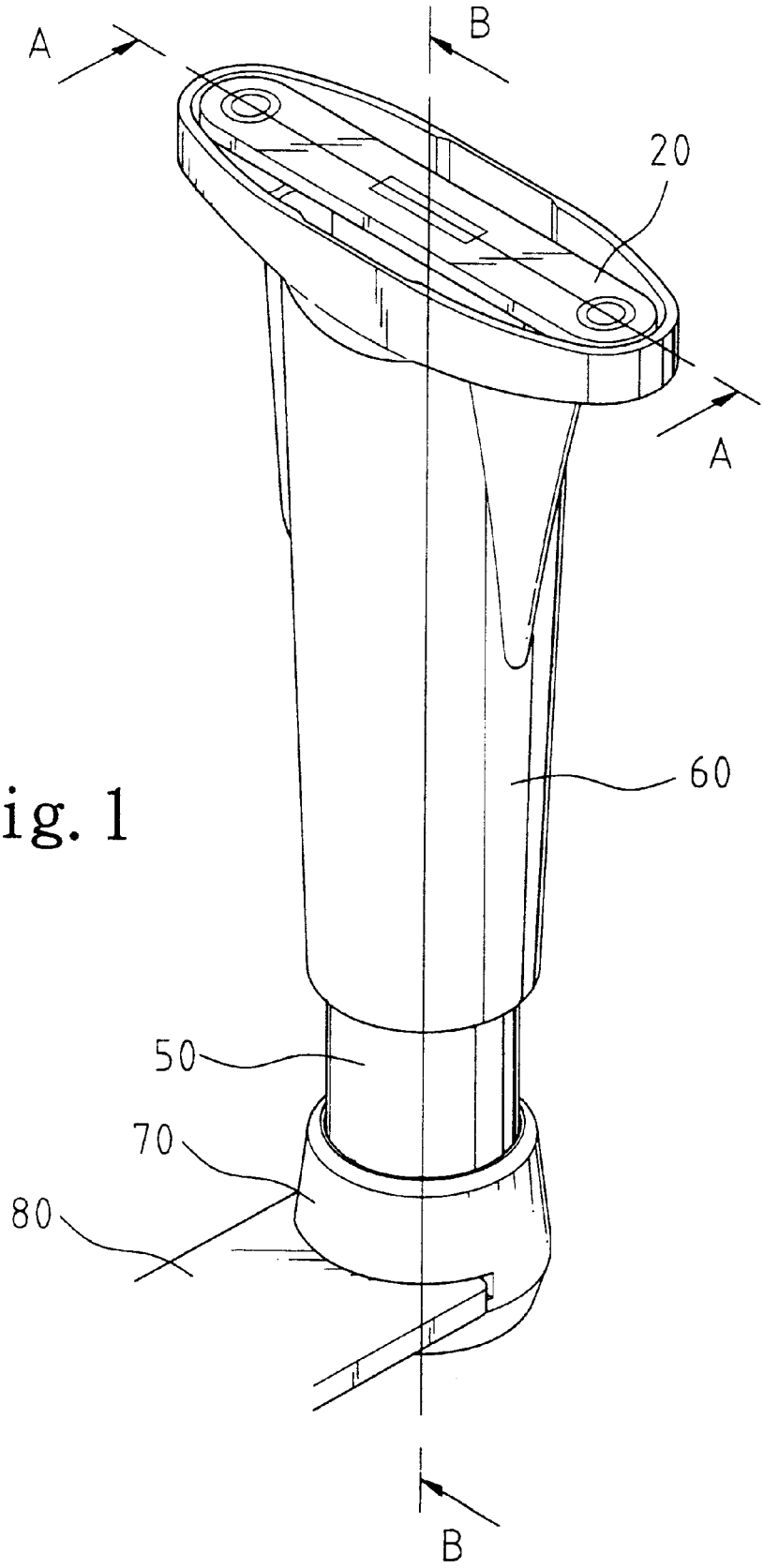
FIG. 1 is a perspective view of an armrest assembly in accordance with the present invention, wherein the armrest is removed for showing the inner structure.
Figure 2:
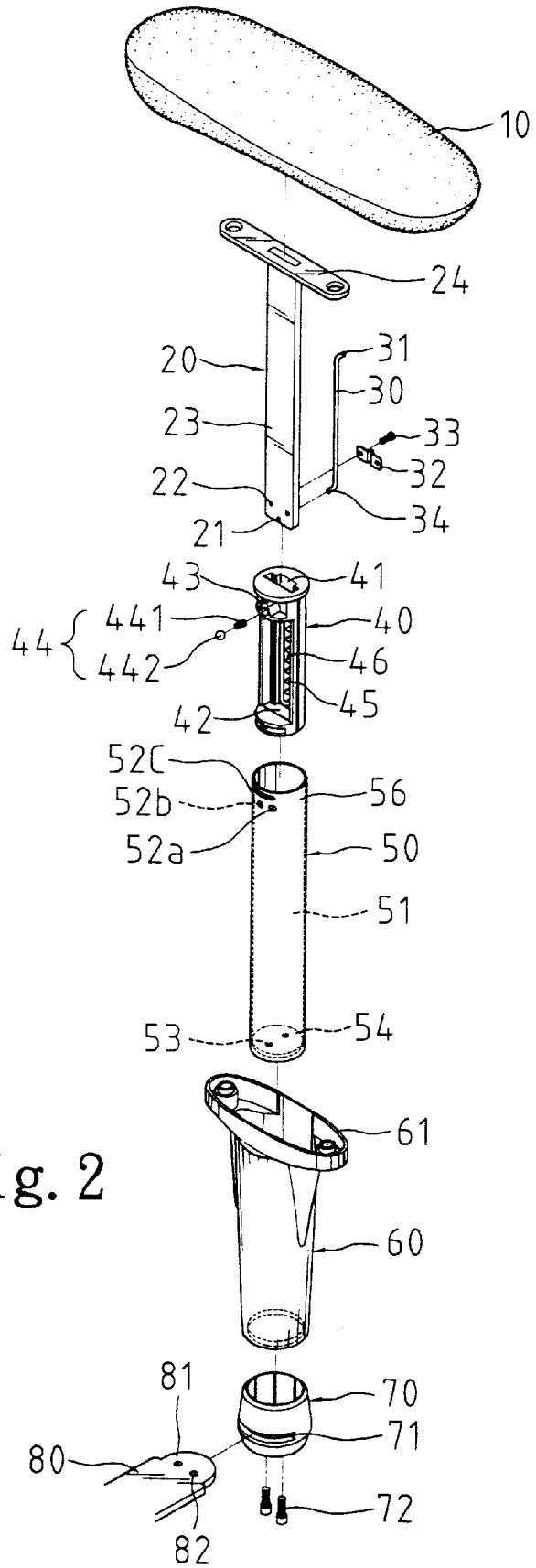
FIG. 2 is an exploded perspective view of the armrest assembly in accordance with the present invention.

Referring to FIGS. 1 through 9 and initially to FIGS. 1 and 2, an armrest assembly in accordance with the present invention generally includes an armrest 10, an actuating member 20, a positioning member 30, an adjusting seat 40, a tube 50, a sleeve 60, and a mounting seat 70. The mounting seat 70 includes a slot 71 through which an extension 81 of a chair seat 80 extends. The tube 50 includes a lower end 54 that is secured to the extension 81 of the chair seat 80 by means of extending screws 72 through screw holes 82 in the extension 81 and screw holes 53 defined in the lower end 54 of the tube 50. Thus, the lower end of the tube 50 is fixed to the chair seat 80. An upper end 56 of the tube 50 includes, e.g., three angularly spaced positioning holes 52*a,* 52*b,* and 52*c,* which will be described later.

The adjusting seat 40 is swivelably mounted in the tube 50. The actuating member 20 is substantially T-shaped and includes a vertical section slidably mounted in the adjusting seat 40 and a horizontal section 24 secured to the armrest 10. Namely, the upper end (namely the section 24) of the actuating member 20 is fixed to the armrest 10 to move therewith. In addition, the sleeve 60 is slidably mounted around the tube 50 and includes an upper end 61 that is also fixed to the armrest 10 to move therewith. Thus, the actuating member 20 will be moved vertically when the sleeve 60 is manually moved vertically.

Figure 8:
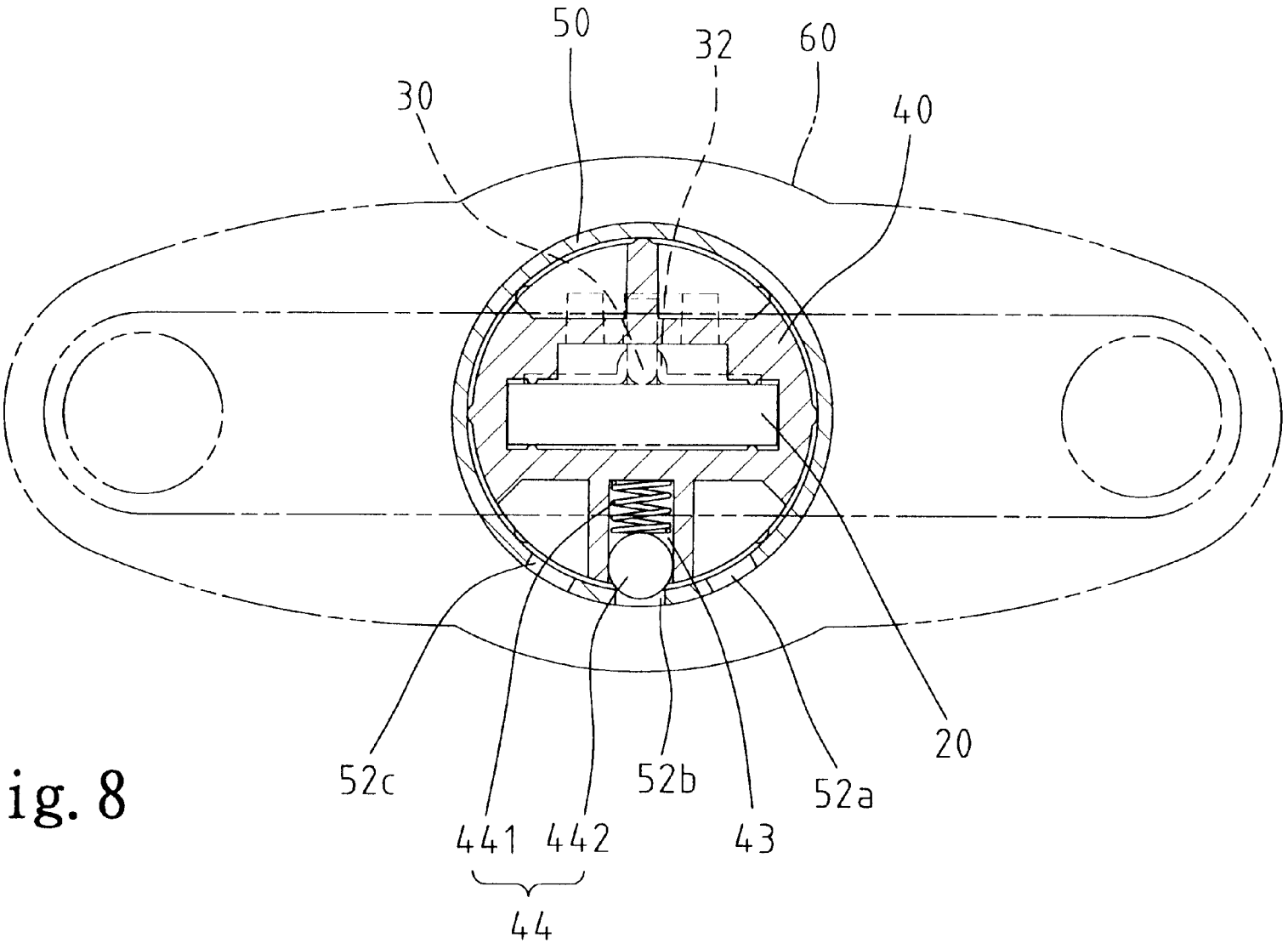
FIGS. 8 and 9 illustrate swivel movement of the armrest assembly in accordance with the present invention, wherein the armrest in FIG. 8 has an angular position different from that in FIG. 9.
Figure 9:
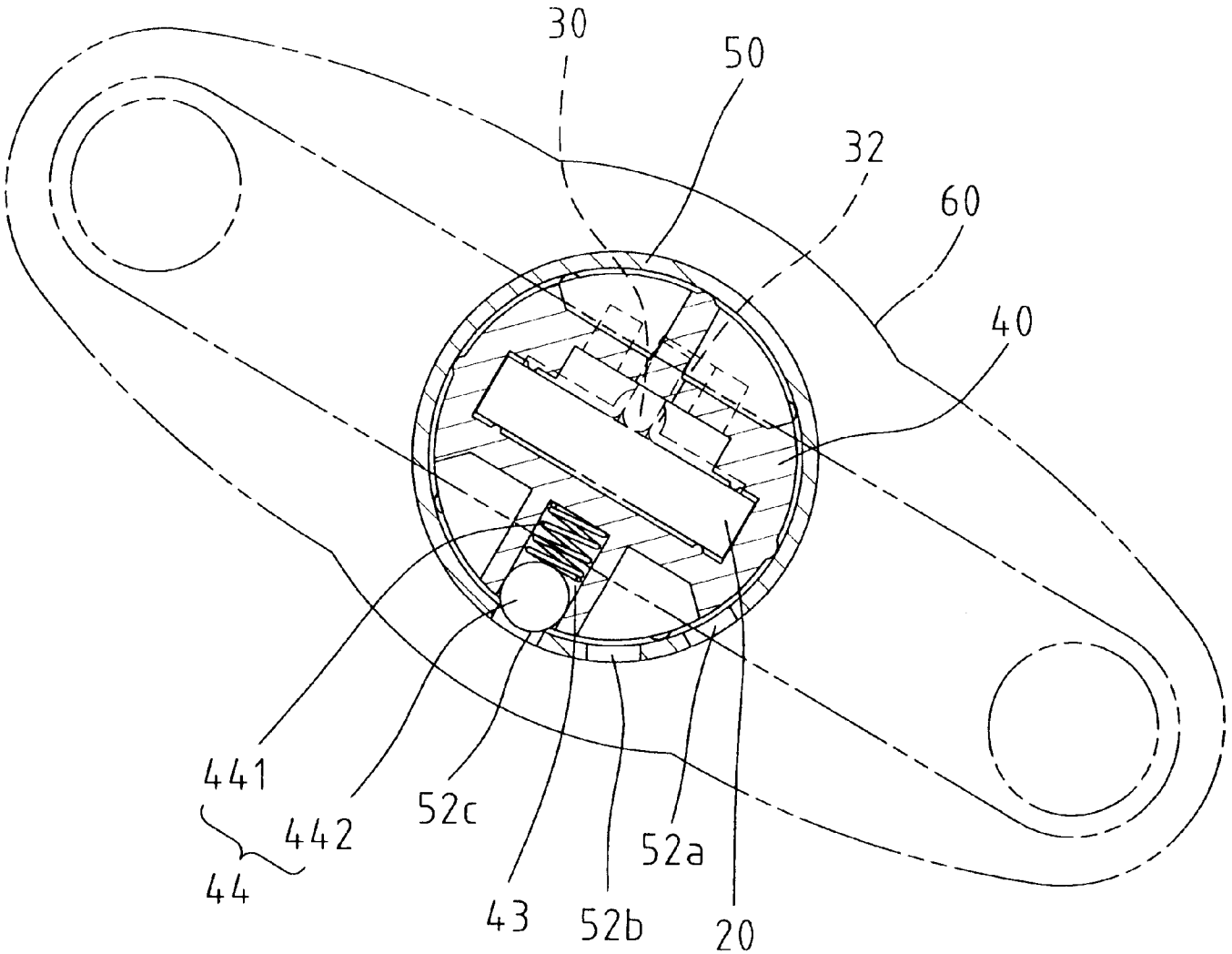
Figure 10:
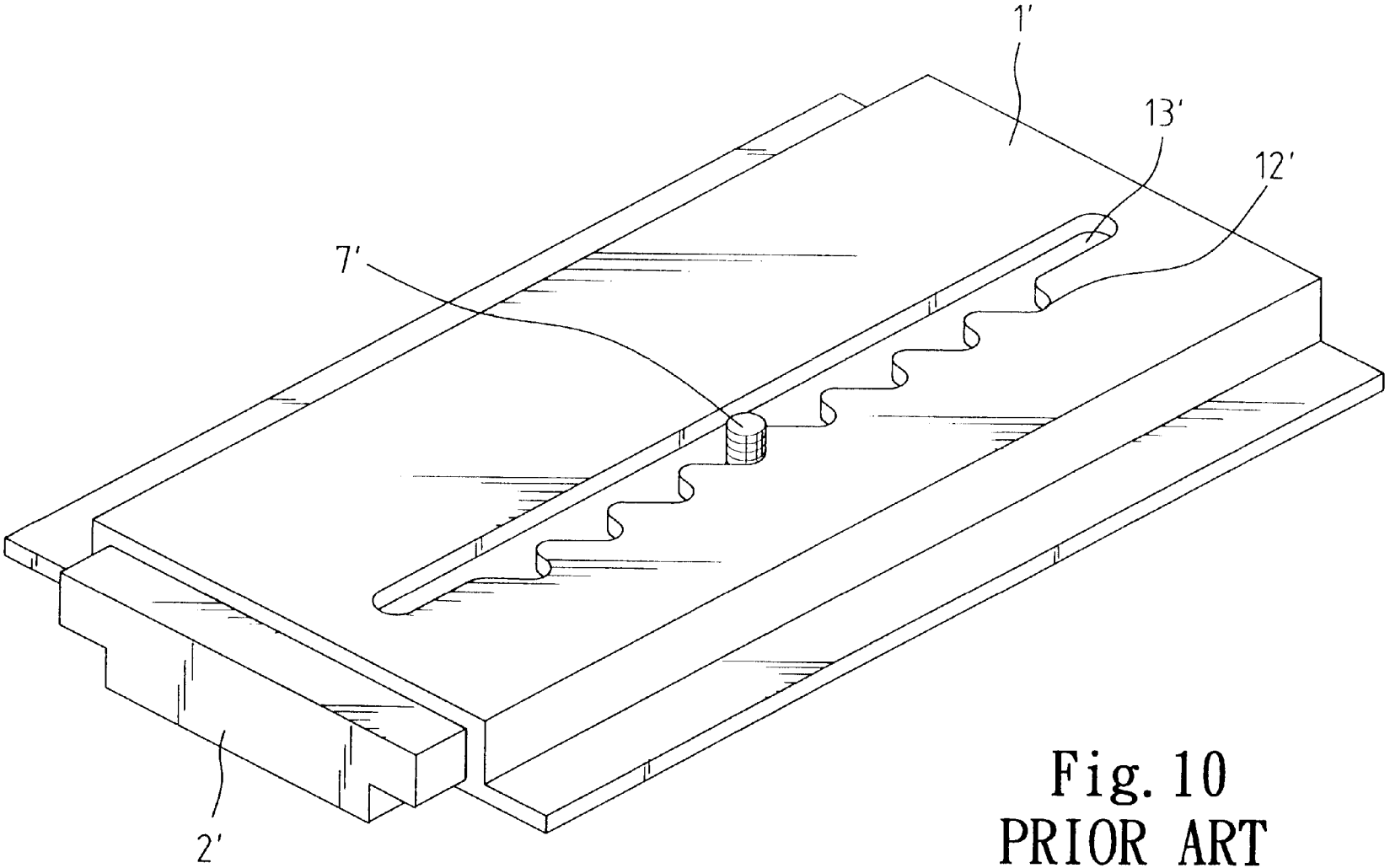
Fig. 10 PRIOR ART
FIG. 10 is a perspective view of a conventional level-adjusting device for an armrest.
Figure 11:
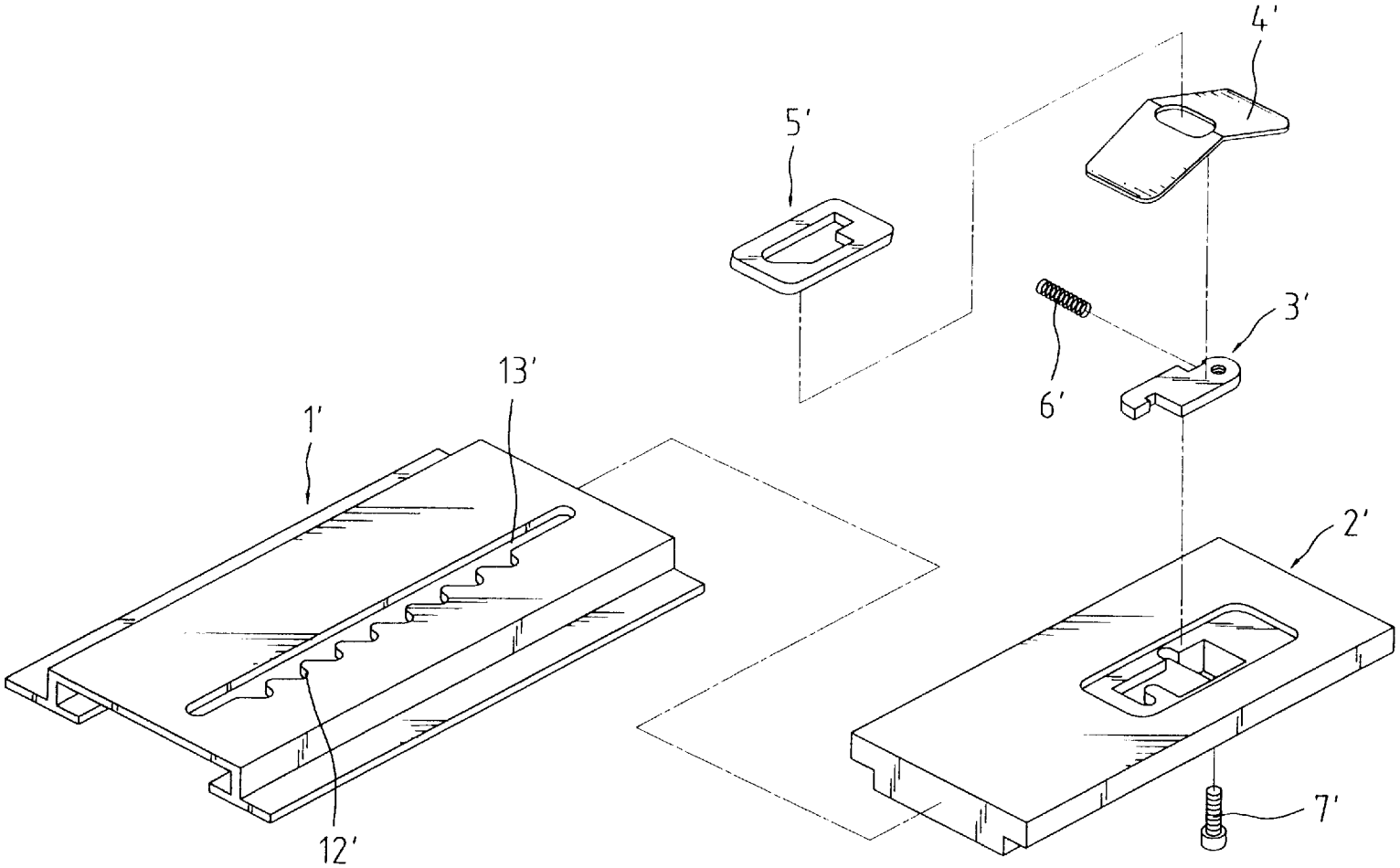
Fig. 11 PRIOR ART
FIG. 11 is an exploded perspective view of the conventional level-adjusting device in FIG. 10.

In this embodiment, the adjusting seat 40 includes a longitudinal T-shape groove 41 along a length thereof. The adjusting seat 40 further includes a side compartment 42 that is communicated with the T-shape groove 41. A receptacle 43 is defined in an upper end of the adjusting seat 40 for receiving an elastic means 44 consisting of an elastic element 441 and a ball 442. As illustrated in FIG. 8, the ball 442 is biased radially outward by the elastic element 441 and thus partially protruded into one of the positioning holes, e.g., 52*b.* When the user swivels the armrest 10, the adjusting seat 40 is swiveled, as the vertical section 23 of the actuating member 20 is engaged in the T-shape groove 41 of the adjusting seat 40. As a result, the ball 442 is moved inward into the receptacle 43 and moves together with the adjusting seat 40 until the ball 442 is aligned with another positioning hole, e.g., 52*c.* The ball 442 is then biased radially outward by the elastic element 441 and thus partially protruded into and retained in the positioning hole 52*c*, best shown in FIG. 9. Thus, the armrest 10 may be swiveled among a plurality of angular positions relative to the seat 80 to provide comfort resting for the user's arm. It is noted that the ball 442 may be substituted by other positioning elements, such as a pin with a dome.

Turning back to FIG. 2, a lower end of the vertical section 23 of the actuating member 20 includes a hole 21 and two screw holes 22 above the hole 21. The positioning member 30 is substantially ∫ shape and includes a first end 34 secured in the hole 21 and a second end 31. The first end 34 of the positioning member 30 is secured to the vertical section 23 of the actuating member 20 by means of extending screws 33 through a mounting strip 32 and the screw holes 22. Thus, the positioning member 30 moves together with the actuating member 20.

Figure 3:
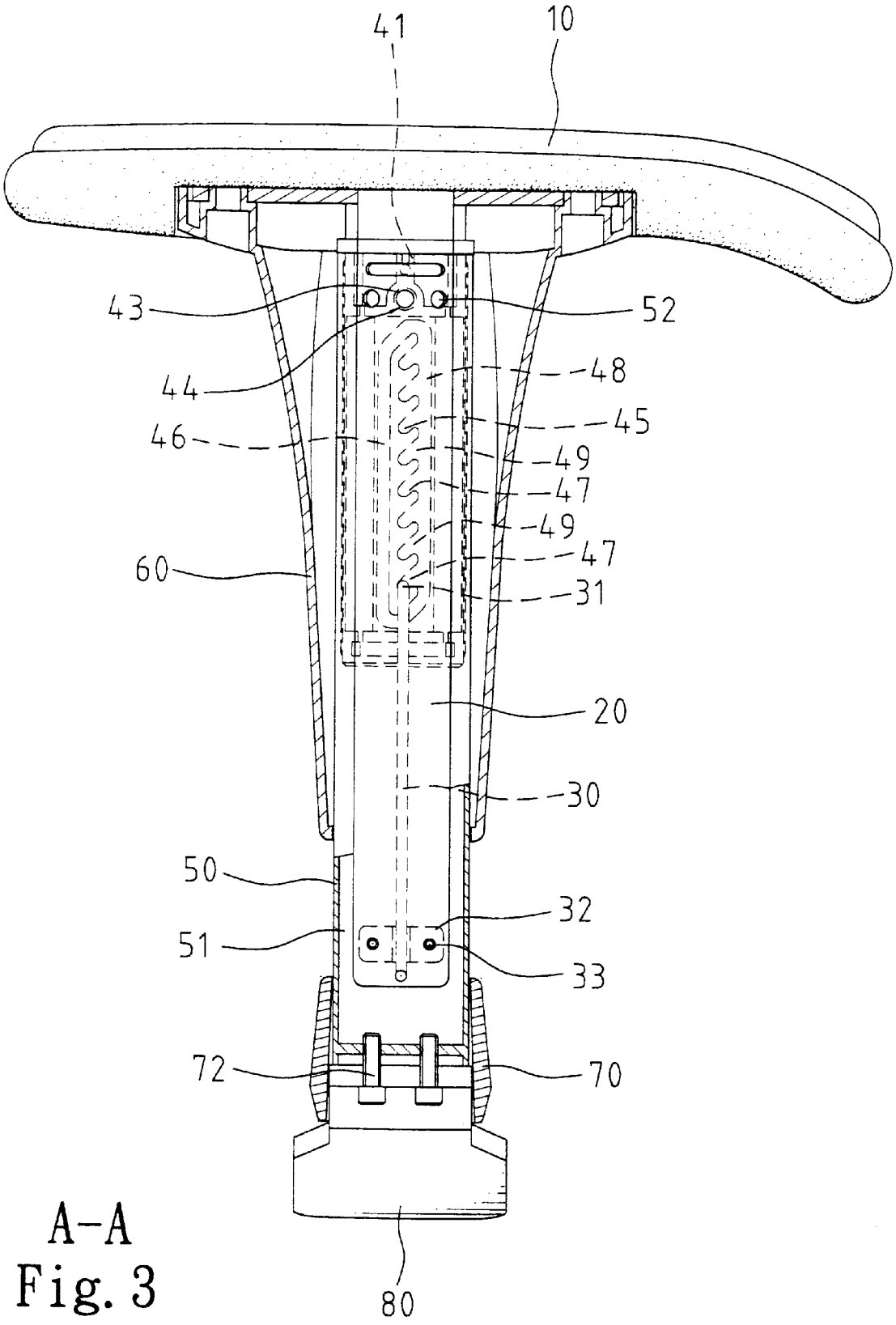
FIG. 3 is a sectional view taken along line A—A in FIG. 1.

Referring to FIGS. 2 and 3, the adjusting seat 40 includes an adjusting section 45 including a first vertical slide passage 48. A peripheral side defining the first vertical slide passage 48 includes a plurality of vertically spaced inclined positioning notches 47 each having an opening 49 (FIG. 3) facing upward and outward. The adjusting section 45 further includes a second vertical slide passage 46. The first vertical slide passage 48 and the second vertical slide passage 46 together define a loop-like passage for the second end 31 of the positioning member 30. Namely, the second end 31 of the positioning member 30 may slide along the loop-like passage consisting of the vertical slide passages 46 and 48 and may be retained in a selected positioning notch 47 when required.

Figure 4:
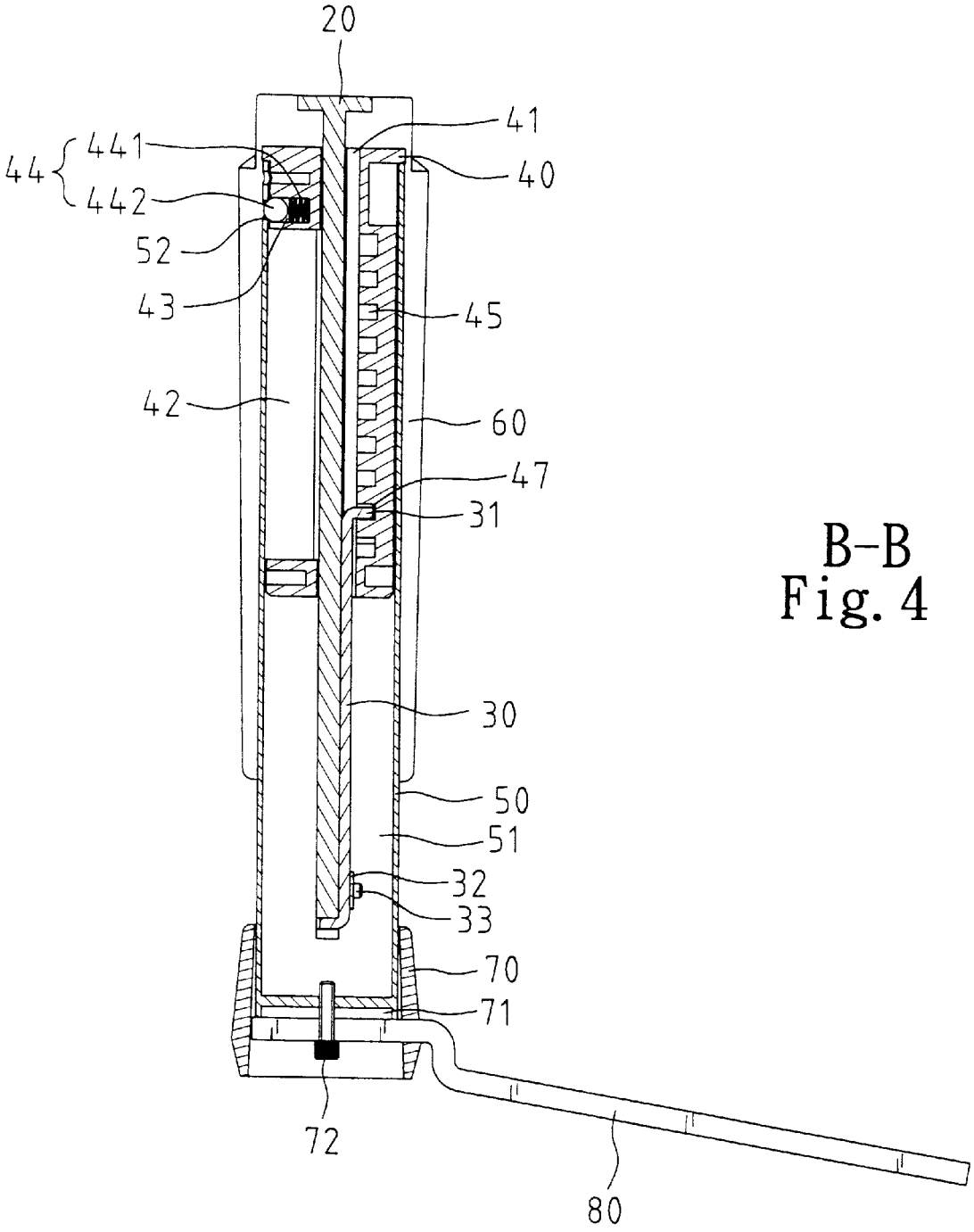
FIG. 4 is a sectional view taken along line B—B in FIG. 1.
Figure 5:
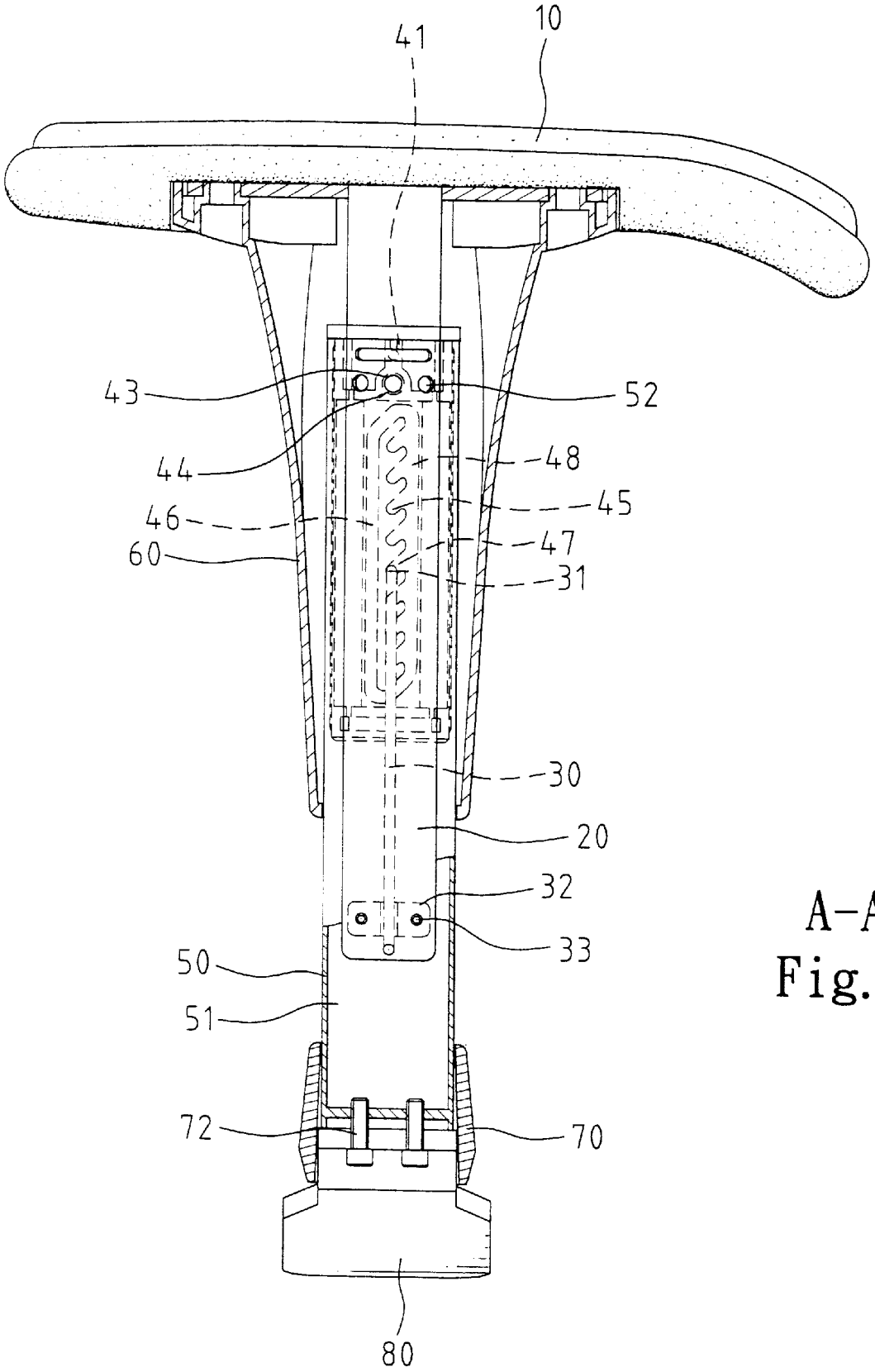
FIG. 5 is a sectional view similar to FIG. 3, illustrating adjustment in level of the armrest.
Figure 6:
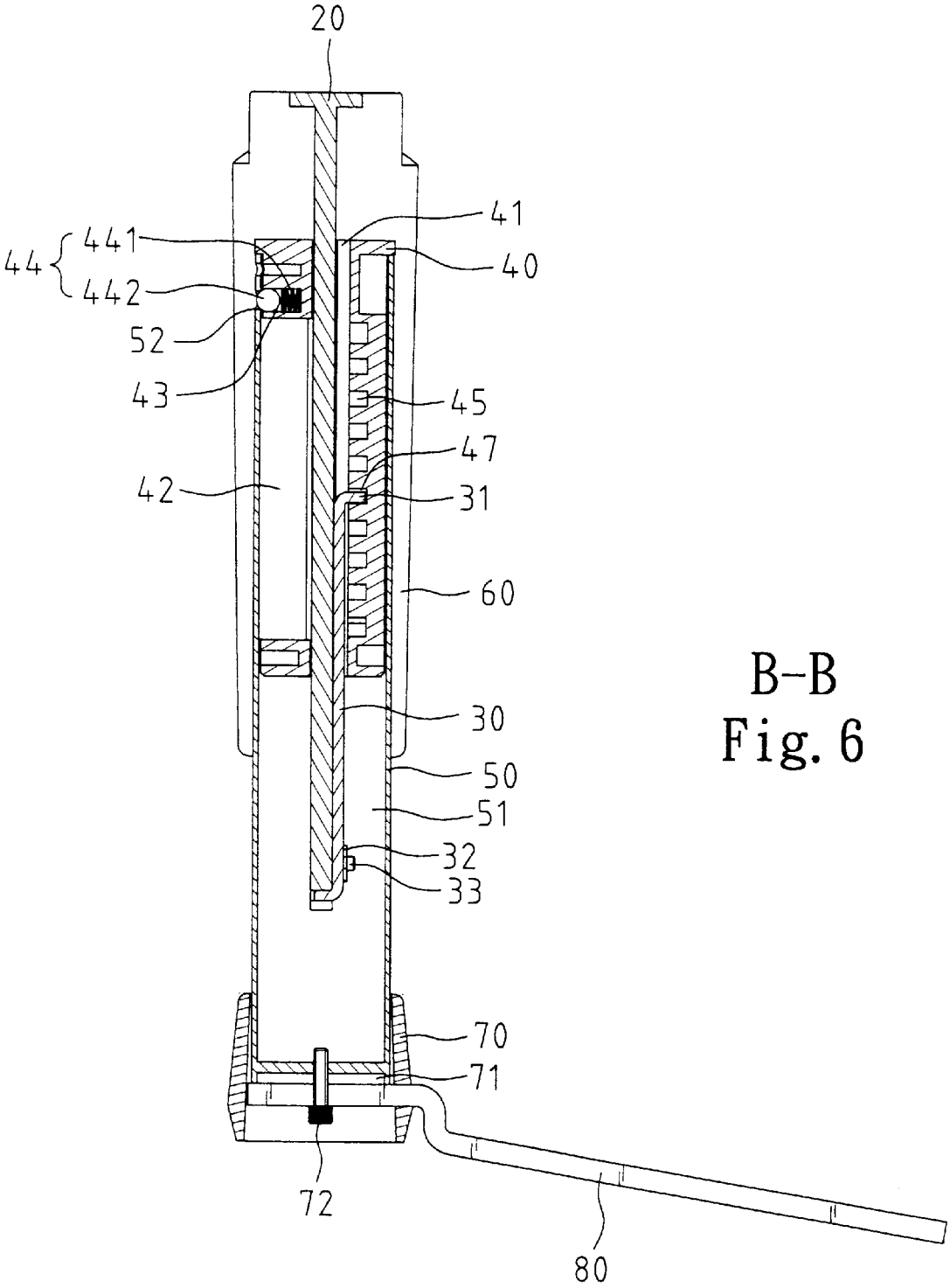
FIG. 6 is a sectional view similar to FIG. 4, illustrating adjustment in level of the armrest.

Turning to FIGS. 3 and 4, it is noted that the armrest 10 is in its lowermost position, as the second end 31 of the positioning member 30 is retained in the lowermost positioning notch 47. When the user intends to adjust the level of the armrest 10, he/she may directly moves the sleeve 60 or the armrest 10 upward. As the actuating member 20 and the positioning member 30 move together with the sleeve 60 and the armrest 10, the second end 31 of the positioning member 30 is moved out of the lowermost positioning notch 47 under the guidance of the inclined positioning notch 47. Thus, the second end 31 of the positioning member 30 may be moved to a desired level along the first vertical slide passage 48. Then, the user exerts an inclined downward force to armrest 10 to make the second end 31 of the positioning member 30 enter an associated positioning notch 47, best shown in FIGS. 5 and 6.

Figure 7:
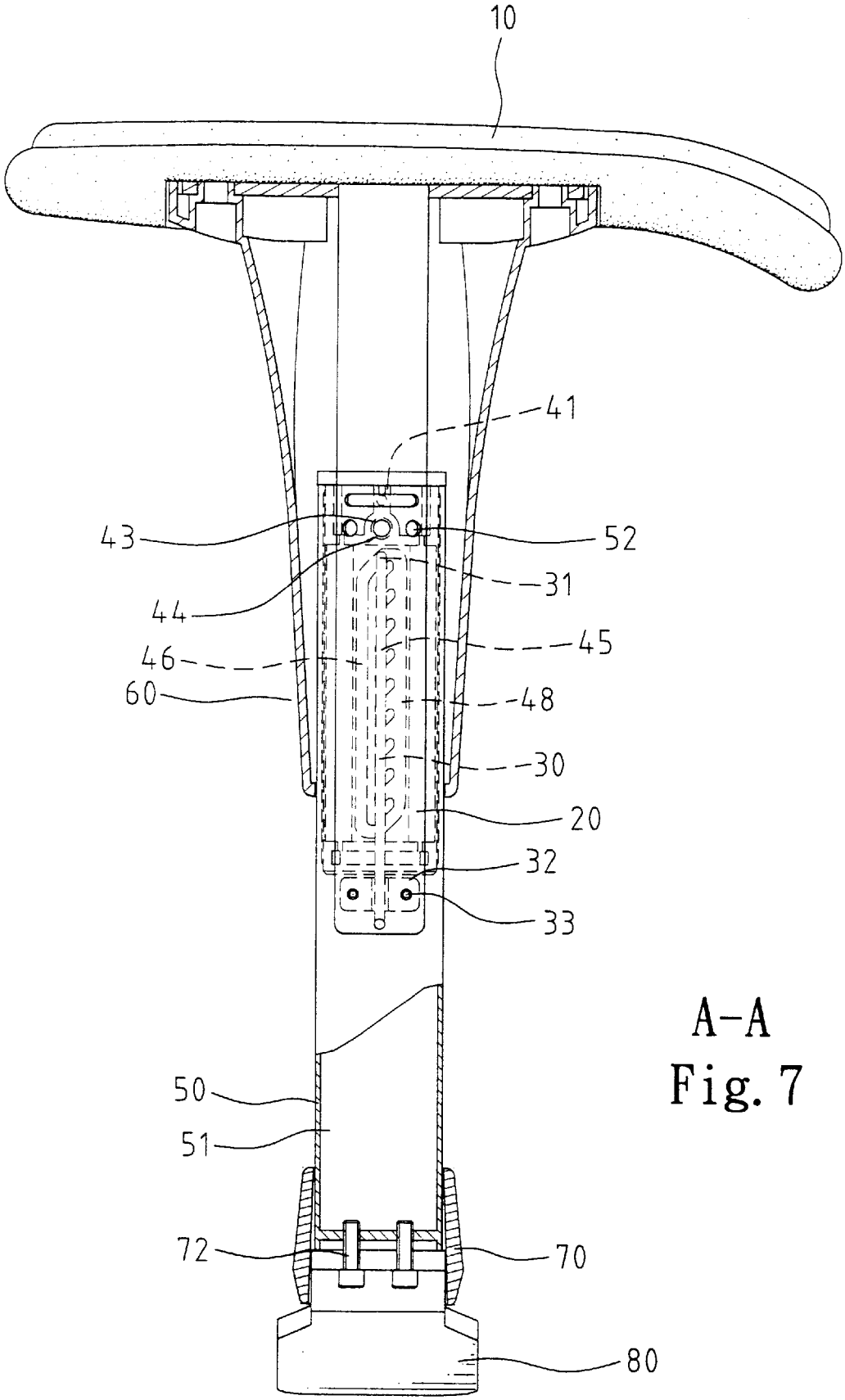
FIG. 7 is a sectional view similar to FIG. 3, illustrating re-adjustment in level of the armrest.

Referring to FIG. 7, when the armrest 10 is moved to its uppermost position, and it is found too high for the user's arm, the user may exert a downward force to lower the armrest 10 while the second end 31 of the positioning member 30 is moved back to the lowermost position along the second vertical slide passage 46. The adjustment in the level of the armrest 10 can be easily achieved with a reliable positioning effect.

Although the invention has been explained in relation to its preferred embodiment, it is to be understood that many other possible modifications and variations can be made without departing from the spirit and scope of the invention as hereinafter claimed.

What is claimed is:

1. An armrest assembly comprising:

a tube adapted to be secured to a chair seat;

an adjusting seat mounted in the tube and including an adjusting section, the adjusting section including a first vertical slide passage, a peripheral side defining the first vertical slide passage including a plurality of vertically spaced positioning notches, the adjusting section further including a second vertical slide passage, the first vertical side passage and the second vertical slide passage together defining a loop passage;

an armrest mounted above the adjusting seat; and an actuating member including an upper end secured to the armrest to move therewith, the actuating member further including a lower end slidably received in the adjusting seat, the actuating member including a positioning member attached thereto, the positioning member including an end slidable along the loop passage and being selectively and releasably engaged in one of the positioning notches for supporting the armrest at a desired level.

2. The armrest assembly as claimed in claim 1, wherein each said positioning notch includes an opening that faces upward and outward.

3. The armrest assembly as claimed in claim 1, wherein the lower end of the actuating member includes a hole and the positioning member includes a second end engaged in the hole of the actuating member.

4. The armrest assembly as claimed in claim 1, wherein the adjusting seat includes a longitudinal slot along a length thereof for slidably receiving the lower end of the actuating member.

5. The armrest assembly as claimed in claim 1, further comprising a sleeve slidably mounted around the tube, the sleeve being securely engaged with the armrest to slide therewith.

6. The armrest assembly as claimed in claim 1, wherein the chair seat includes an extension, further comprising a mounting seat including a slot through which the extension extends, the adjusting seat including a lower end securely attached to the extension located in the mounting seat.

7. The armrest assembly as claimed in claim 1, wherein the tube includes a plurality of angularly spaced positioning holes, further comprising:

a positioning element mounted to the adjusting seat, and means for biasing the positioning element to releasably engaged with one of the positioning holes, thereby allowing the armrest to be swiveled relative to the chair seat.

8. The armrest assembly as claimed in claim 7, wherein the positioning element is a ball, and the biasing means is an elastic element.

9. An armrest assembly comprising:

a tube adapted to be secured to a chair seat, the tube including a plurality of angularly spaced positioning holes;

an adjusting seat mounted in the tube;

an armrest mounted above the adjusting seat; and an actuating member including an upper end secured to the armrest to move therewith, the actuating member further including a lower end engaged in the adjusting seat, whereby swivel movement of the armrest cause swivel movement of the adjusting seat, a positioning element mounted to the adjusting seat, and means for biasing the positioning element to releasably engaged with one of the positioning holes, thereby allowing the armrest to be swiveled relative to the chair seat.

10. The armrest assembly as claimed in claim 9, wherein the positioning element is a ball, and the biasing means is an elastic element.

11. The armrest as claimed in claim 9, wherein the adjusting seat includes a receptacle, and wherein the biasing means is an elastic element received in the receptacle, and the positioning element is a ball that is biased radially outward by the elastic element and is thus partially extended into one of the positioning holes.

12. The armrest as claimed in claim 9, wherein the adjusting seat includes an adjusting section having a first vertical slide passage, a peripheral side defining the first vertical slide passage including a plurality of vertically spaced positioning notches, the adjusting section further including a second vertical slide passage, the first vertical side passage and the second vertical slide passage together defining a loop passage;

the actuating member including a positioning member attached thereto, the positioning member including an end slidable along the loop passage and being selectively and releasably engaged in one of the positioning notches for supporting the armrest at a desired level.

13. The armrest assembly as claimed in claim 12, wherein each said positioning notch includes an opening that faces upward and outward.

14. The armrest assembly as claimed in claim 12, wherein the lower end of the actuating member includes a hole and the positioning member includes a second end engaged in the hole of the actuating member.

15. The armrest assembly as claimed in claim 12, wherein the adjusting seat includes a longitudinal slot along a length thereof for slidably receiving the lower end of the actuating member.

16. The armrest assembly as claimed in claim 12, further comprising a sleeve slidably mounted around the tube, the sleeve being securely engaged with the armrest to slide therewith.

17. The armrest assembly as claimed in claim 12, wherein the chair seat includes an extension, further comprising a mounting seat including a slot through which the extension extends, the adjusting seat including a lower end securely attached to the extension located in the mounting seat.

* * * * *